US006429820B1

(12) United States Patent
Thursby et al.

(10) Patent No.: US 6,429,820 B1
(45) Date of Patent: Aug. 6, 2002

(54) HIGH GAIN, FREQUENCY TUNABLE VARIABLE IMPEDANCE TRANSMISSION LINE LOADED ANTENNA PROVIDING MULTI-BAND OPERATION

(75) Inventors: Michael H. Thursby; Kerry L. Greer; Sean F. Sullivan; Young-Min Jo, all of Palm Bay, FL (US)

(73) Assignee: SkyCross, Inc., Melbourne, FL (US)

( * ) Notice: Subject to any disclaimer, the term of this patent is extended or adjusted under 35 U.S.C. 154(b) by 3 days.

(21) Appl. No.: 09/724,332

(22) Filed: Nov. 28, 2000

(51) Int. Cl.[7] ..... H01Q 11/12
(52) U.S. Cl. ..... 343/744; 343/741; 343/745
(58) Field of Search ..... 343/744, 745, 343/741, 742, 743, 749, 829, 846, 866, 867, 728

(56) References Cited

U.S. PATENT DOCUMENTS

| | | | | |
|---|---|---|---|---|
| 2,688,083 A | | 8/1954 | Hills | 343/791 |
| 5,061,944 A | | 10/1991 | Powers et al. | 343/795 |
| 5,790,080 A | | 8/1998 | Apostolos | 343/744 |
| 5,926,150 A | | 7/1999 | McLean et al. | 343/846 |
| 6,025,811 A | | 2/2000 | Canora et al. | 343/793 |
| 6,094,170 A | | 7/2000 | Peng | 343/700 MS |
| 6,323,814 B1 | * | 11/2001 | Apostolos | 343/744 |

FOREIGN PATENT DOCUMENTS

| | | | |
|---|---|---|---|
| EP | 0 691 738 A1 | 7/1995 | H03H/7/40 |
| EP | 0 963 004 A2 | 6/1999 | H01Q/9/36 |
| EP | 1 026 774 A2 | 1/2000 | H01Q/1/24 |

* cited by examiner

*Primary Examiner*—Don Wong
*Assistant Examiner*—Hoang Nguyen
(74) *Attorney, Agent, or Firm*—John L. DeAngelis, Jr.; Holland & Knight LLP

(57) ABSTRACT

There is disclosed a meanderline loaded antenna comprising a ground plane, a plurality of vertical elements orthogonally affixed thereto, a driven vertical element affixed thereto and a horizontal element between the vertical elements. All but one of the plurality of vertical elements have an effective electrical length that is a quarter wavelength of the antenna operating frequency. Thus, these vertical elements represent an open and do not effect the antenna performance characteristics. One of the plurality of vertical elements will be operative and therefore the antenna length comprises the length of the operative element, the length of the driven element, and the length of the top plate therebetween.

25 Claims, 7 Drawing Sheets

HIGH GAIN, FREQUENCY TUNABLE VARIABLE IMPEDANCE TRANSMISSION LINE LOADED ANTENNA PROVIDING MULTI-BAND OPERATION

BACKGROUND OF THE INVENTION

The present invention relates generally to antennae loaded by a plurality meanderlines (also referred to as variable impedance transmission lines), and specifically to such an antenna providing multi-band operation.

It is generally known that antenna performance is dependent upon the antenna shape, the relationship between the antenna physical parameters (e.g., length for a linear antenna and diameter for a loop antenna) and the wavelength of the signal received or transmitted by the antenna. These relationships determine several antenna parameters, including input impedance, gain, and the radiation pattern shape. Generally, the minimum physical antenna dimension must be on the order of a quarter wavelength of the operating frequency, thereby allowing the antenna to be excited easily and to operate at or near its resonant frequency, which in turn limits the energy dissipated in resistive losses and maximizes the antenna gain.

The burgeoning growth of wireless communications devices and systems has created a significant need for physically smaller, less obtrusive, and more efficient antennae, that are capable of operation in multiple frequency bands. As is known to those skilled in the art, there is an inherent conflict between physical antenna size and antenna gain, at least with respect to single-element antennae. Increased gain requires a physically larger antenna, while users continue to demand physically smaller antennae. As a further constraint, to simplify the system design and strive for minimum cost, equipment designers and system operators prefer to utilize antennae capable of efficient multi-frequency and wide bandwidth operation. Finally, it is known that the relationship between the antenna frequency and the antenna length (in wavelengths) determines the antenna gain. That is, the antenna gain is constant for all quarter wavelength antennae (i.e., at that frequency where the antenna length is a quarter of a wavelength).

One prior art technique that addresses certain of these antenna requirements is the so-called "Yagi-Uda" antenna, which has been successfully used for many years in applications such as the reception of television signals and point-to-point communications. The Yagi-Uda antenna can be designed with high gain (or directivity) and a low voltage-standing-wave ratio (i.e., low losses) throughout a narrow band of contiguous frequencies. It is also possible to operate the Yagi-Uda antenna in more than one frequency band, provided that each band is relatively narrow and that the mean frequency of any one band is not a multiple of the mean frequency of another band.

Specifically, in the Yagi-Uda antenna, there is a single element driven from a source of electromagnetic radio frequency (RF) radiation. That driven element is typically a half-wave dipole antenna. In addition to the half-wave dipole element, the antenna has certain parasitic elements, including a reflector element on one side of the dipole and a plurality of director elements on the other side of the dipole. The director elements are usually disposed in a spaced-apart relationship in the antenna portion pointing in the transmitting direction or, in accordance with the antenna reciprocity theorem, in the receiving direction. The reflector element is disposed on the side of the dipole opposite from the array of director elements. Certain improvements in the Yagi-Uda antenna are set forth in U.S. Pat. No. 2,688,083 (disclosing a Yagi-Uda antenna configuration to achieve coverage of two relatively narrow non-contiguous frequency bands), and U.S. Pat. No. 5,061,944 (disclosing the use of a full or partial cylinder partly enveloping the dipole element).

U.S. Pat. No. 6,025,811 discloses an invention directed to a dipole array antenna having two dipole radiating elements. The first element is a driven dipole of a predetermined length and the second element is an unfed dipole of a different length, but closely spaced from the driven dipole and excited by near-field coupling. This antenna provides improved performance characteristics at higher microwave frequencies.

BRIEF SUMMARY OF THE INVENTION

The present invention discloses an antenna comprising one or more conductive elements, including a horizontal element and one or more vertical elements interconnected by meanderline couplers, and a ground plane. The meanderline coupler has an effective length that controls the electrical length and operating characteristics of the antenna. Further, the use of multiple vertical elements (each including one or more meanderline couplers) provides operation in multiple frequency bands.

BRIEF DESCRIPTION OF THE DRAWINGS

The present invention can be more easily understood and the further advantages and uses thereof more readily apparent, when considered in view of the description of the preferred embodiments and the following figures in which.

DETAILED DESCRIPTION OF THE PREFERRED EMBODIMENTS

Figure 1:
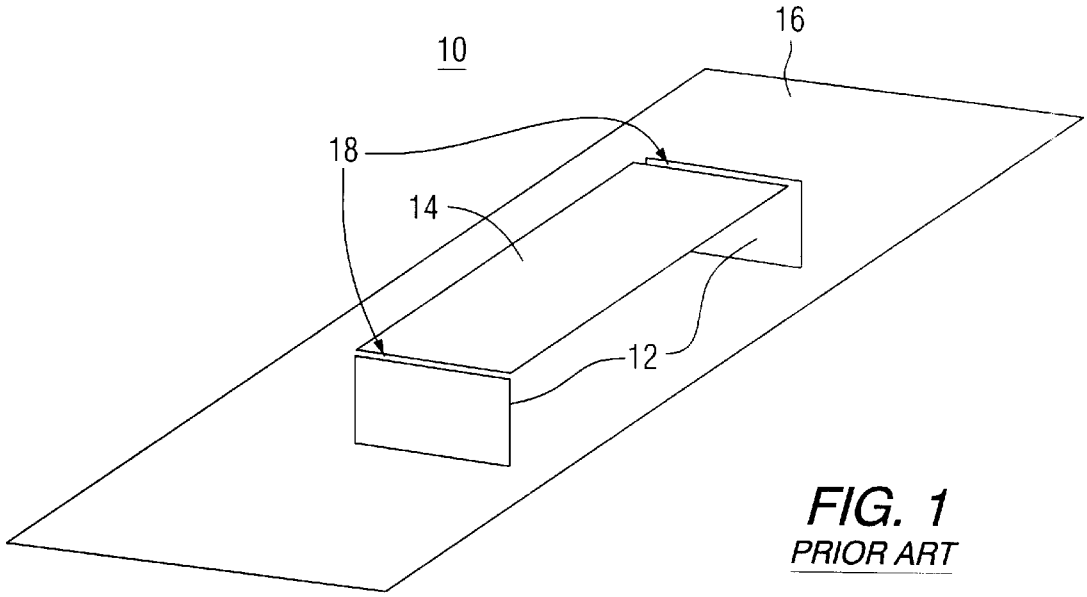
FIG. 1 PRIOR ART
FIG. 1 is a perspective view of a meanderline loaded antenna of the prior art.

Before describing in detail the particular multi-band meanderline loaded antenna constructed according to the teachings of the present invention, it should be observed that the present invention resides primarily in a novel and non-obvious combination of apparatus related to meanderline loaded antennae and antenna technology in general. Accordingly, the hardware components described herein have been represented by conventional elements in the drawings and in the specification description, showing only those specific details that are pertinent to the present invention, so as not to obscure the disclosure with structural details that will be readily apparent to those skilled in the art having the benefit of the description herein.

Figure 2:
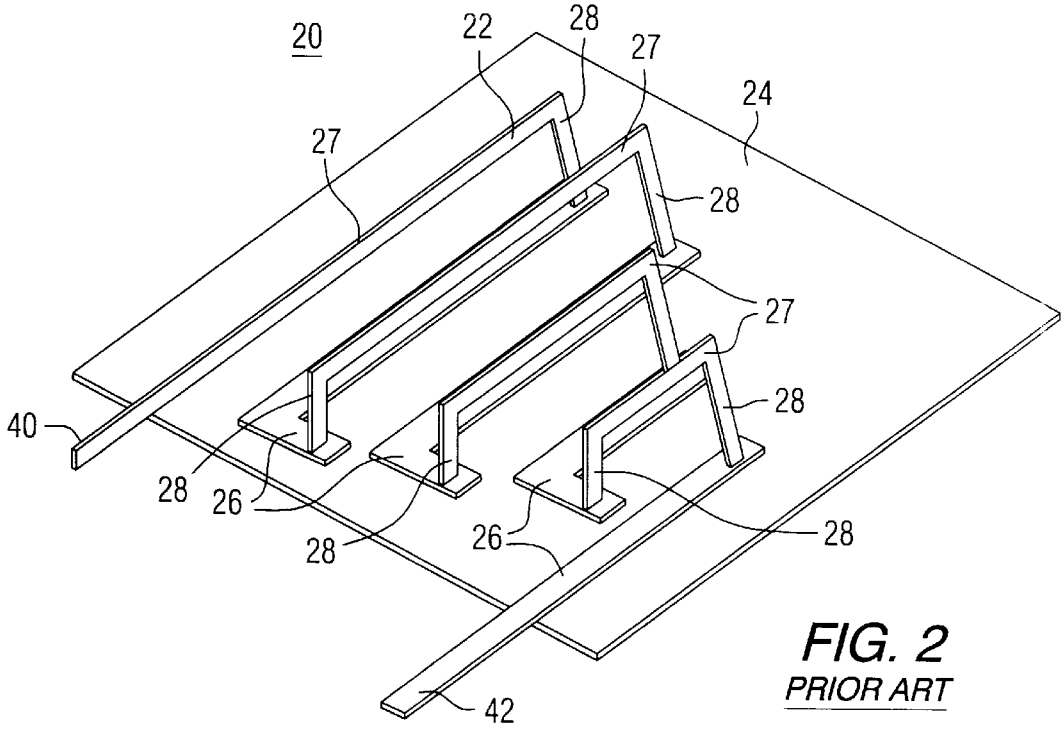
FIG. 2 PRIOR ART
FIG. 2 is a perspective view of a prior art meanderline conductor used as an element coupler in the meanderline loaded antenna of FIG. 1.

FIGS. 1 and 2 depict a prior art meanderline loaded antenna (See U.S. Pat. No. 5,790,080). Further details of the meanderline loaded antenna can be found in the commonly-assigned U.S. Patent Application entitled, High Gain, Frequency Tunable Variable Impedance Transmission Line Loaded Antenna with Radiating and Tuning Wings, filed on Aug. 22, 2000 and bearing application Ser. No. 09/643302, to which the teachings of the present invention can be advantageously applied to provide operation in multiple frequency bands for the antenna, while maintaining optimum input impedance characteristics.

An example of a meanderline loaded antenna 10, also known as a variable impedance transmission line antenna, is shown in a perspective view in FIG. 1. Generally speaking, the meanderline loaded antenna 10 includes two vertical conductors 12, a horizontal conductor 14, and a ground plane 16. The vertical conductors 12 are physically separated from the horizontal conductor 14 by gaps 18, but are electrically interconnected to the horizontal conductor 14 by two meanderline couplers, one for each of the two gaps 18, to thereby form an antenna structure capable of radiating and receiving RF energy. The meanderline couplers electrically bridge the gaps 18 and have electrically adjustable lengths to allow for changing the characteristics of the meanderline loaded antenna 10. In one embodiment of the meanderline coupler, segments of the meanderline can be switched in or out of the circuit quickly and with negligible loss, to change the effective length of the meanderline couplers. The antenna parameters are therefore changed by modifying the meanderline lengths. The active switching devices are located in high impedance sections of the meanderline, thereby minimizing the current through the switching devices, resulting in very low dissipation losses in the switch and thereby maintaining high antenna efficiency.

The operational parameters of the meanderline loaded antenna 10 are substantially affected by the frequency of the input signal as determined by the relationship of the meanderline lengths to the input signal wavelength. According to the antenna reciprocity theorem, the antenna parameters are also substantially affected by the receiving signal frequency. Two of the various modes in which the antenna can operate are discussed herein below.

Although illustrated in FIG. 1 as having generally rectangular plates, it is known to those skilled in the art that the vertical conductors 12 and the horizontal conductor 14 can be constructed of a variety of conductive materials. For instance, thin metallic conductors having a length significantly greater than a width, could be used as the vertical conductors 12 and the horizontal conductor 14. Single or multiple lengths of heavy gauge wire or conductive material in a filamental shape could also be used. Finally, it is known that the vertical conductors 12 and the horizontal conductor 14 do not necessarily require parallel opposing sides. For example, a conductive plate having sinuous or wavy edges can be used for the vertical conductors 12 and the horizontal conductor 14.

FIG. 2 shows a perspective view of a meanderline coupler 20 constructed for use in conjunction with the meanderline loaded antenna 10 of FIG. 1. Two meanderline couplers 20 are required for use with the meanderline loaded antenna 10. The meanderline coupler 20 is a slow wave meanderline in the form of a folded transmission line 22 mounted on a plate 24. In one embodiment, the transmission line 22 is constructed from microstrip line. Sections 26 are mounted close to the plate 24; sections 27 are spaced apart from the plate 24. In one embodiment as shown, sections 28, connecting the sections 26 and 27, are mounted orthogonal to the plate 24. The variation in height of the alternating sections 26 and 27 from the plate 24 gives the sections 26 and 27 different impedance values with respect to the plate 24. As shown in FIG. 2, each of the sections 27 is approximately the same distance above the plate 24. However, those skilled in the art will recognize that this is not a requirement for the meanderline coupler 20. Instead, the various sections 27 can be located at differing distances above the plate 24. This modification will change the electrical characteristics of the coupler 20 from the embodiment employing uniform distances. Further, the characteristics of the antenna with which the coupler 20 is utilized will also change. The impedance presented by the meanderline coupler 20 can be changed by changing the material or thickness of the microstrip substrate or by changing the width of the sections 26, 27 or 28. In any case, the meanderline coupler 20 must present a controlled (but controllably variable if the embodiment so requires) impedance.

The sections 26, which are located relatively close to the plate 24 to create a lower characteristic impedance, are electrically insulated from the plate 24 by any suitable dielectric positioned therebetween. The sections 27 are located a controlled distance from the plate 24, wherein the distance determines the characteristic impedance of the section 27 in conjunction with the other physical characteristics of the folded transmission line 22, as well as the frequency of the signal carried by the folded transmission line 22.

Figure 3A:
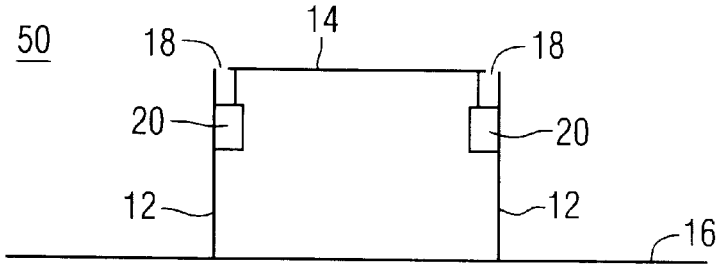
FIG. 3A PRIOR ART
FIGS. 3A through 3B illustrate two embodiments for placement of the meanderline couplers relative to the antenna elements.
Figure 3B:
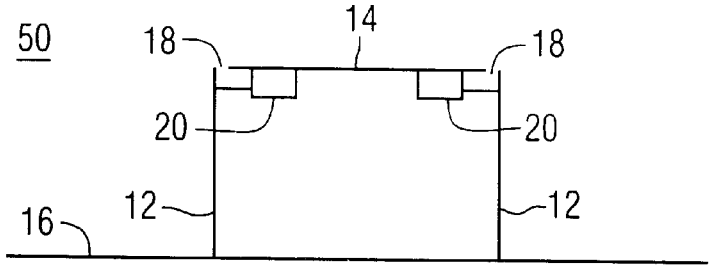
FIG. 3B PRIOR ART

The meanderline coupler 20 includes terminating points 40 and 42 for interconnecting to the elements of the loaded antenna 10. Specifically, FIG. 3A illustrates two meanderline couplers 20, one affixed to each of the vertical conductors 12 such that the vertical conductor 12 serves as the plate 24 from FIG. 2, so as to form a meanderline loaded antenna 50. One of the terminating points shown in FIG. 2, for instance the terminating point 40, is connected to the horizontal conductor 14 and the terminating point 42 is connected to the vertical conductor 12. The second of the two meanderline couplers 20 illustrated in FIG. 3A is configured in a similar manner. FIG. 3B shows the meanderline couplers 20 affixed to the horizontal conductor 14, such that the horizontal conductor 14 serves as the plate 24 of FIG. 2. As in FIG. 3A, the terminating points 40 and 42 are connected to the vertical conductors 12 and the horizontal conductor 14 so as to interconnect the vertical conductors 12 and the horizontal conductor 14 across the gaps 18.

Figure 4:
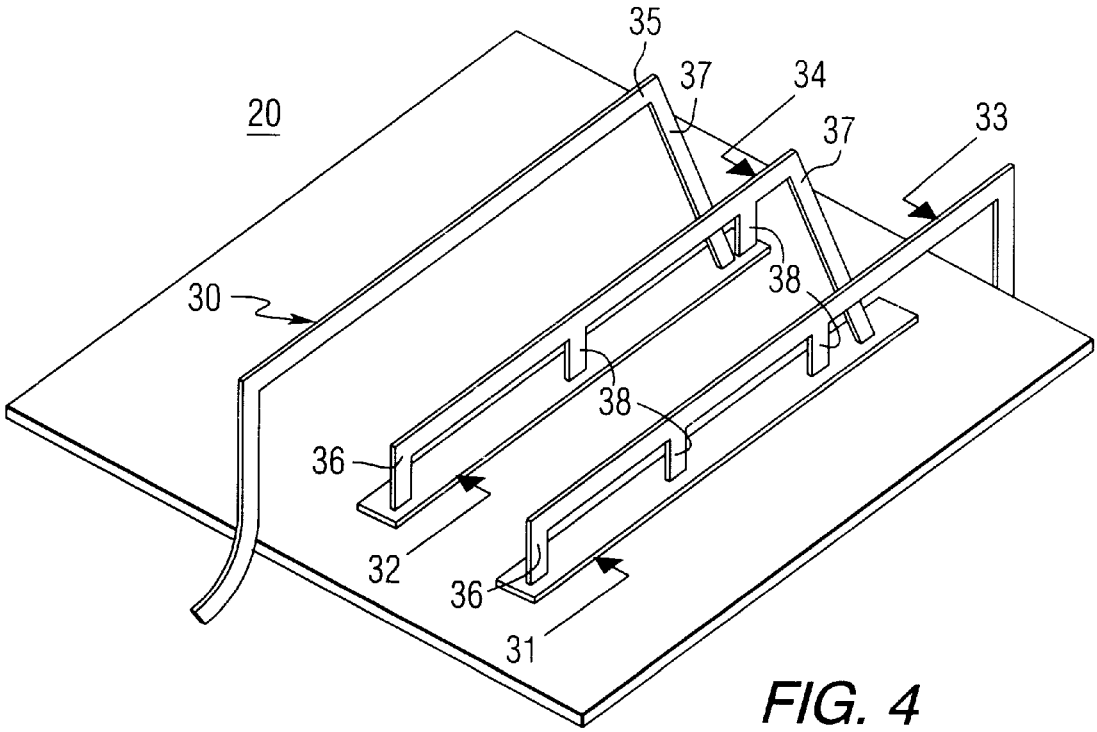
FIG. 4 shows another embodiment of a meanderline coupler.

FIG. 4 is a representational view of a second embodiment of the meanderline coupler 20, including low impedance sections 31 and 32 and relatively higher impedance sections 33, 34, and 35. The low impedance sections 31 and 32 are located in a parallel spaced apart relationship to the higher impedance sections 33 and 34. The sequential low impedance sections 31 and 32 and the higher impedance sections 33, 34, and 35 are connected by substantially orthogonal sections 36 and by diagonal sections 37. The FIG. 4 embodiment includes shorting switches 38 connected between the adjacent low and higher impedance sections 32/34 and 31/33. The shorting switches 38 provide for electronically switchable control of the length of the meanderline coupler 20. As discussed above, the length of the meanderline coupler 20 has a direct impact on the frequency characteristics of the meanderline loaded antenna 50 to which the meanderline couplers 20 are attached, as shown in FIGS. 3A and 3B. As is well known in the art, there are several alternatives for implementing the shorting switches 38, including mechanical switches or electronically controllable switches such as pin diodes. In the embodiment of FIG. 4, all of the low impedance sections 31 and 32 and the higher impedance sections 33, 34, and 35 are of approximately equal length, although this is not necessarily required according to the teachings of the present invention.

Figure 5:
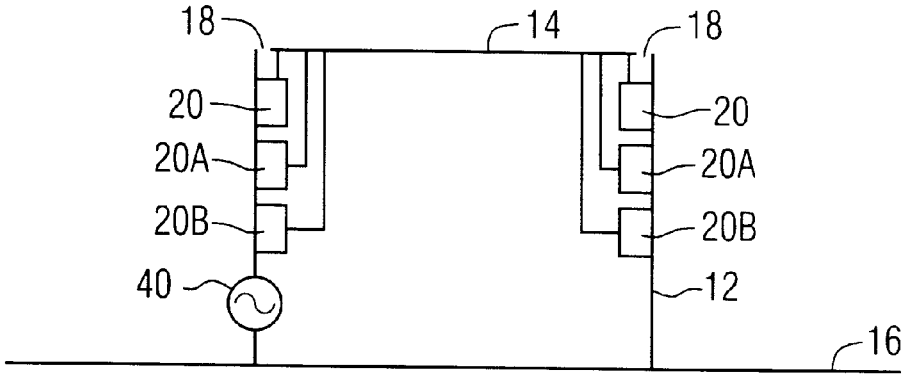
FIG. 5 illustrates the use of a selectable plurality of meanderline couplers with the meanderline loaded antenna of FIG. 1.

The operating mode of the meanderline loaded antenna 50 (in FIGS. 3A and 3B) depends upon the operating frequency and the electrical length of the entire antenna, including the meanderline couplers 20. Thus the meanderline loaded antenna 50, like all antennae, has a specific electrical length, that cause it to operate in a mode determined by the signal operating frequency. That is, different operating frequencies excite the antenna to operate in different modes and therefore produce different antenna radiation patterns. For example, the antenna may exhibit the characteristics of a monopole at a first frequency, but exhibit the characteristics of a loop antenna at a second frequency. Further, the length of one or more of the meanderline couplers 20 can be changed (as discussed above) to effect the antenna electrical length and in this way change the operational mode at a given frequency. Still further, a plurality of meanderline couplers 20 of differing lengths can be connected between the horizontal conductor 14 and the vertical conductors 12. Depending upon the desired antenna operating mode, two matching meanderline couplers 20 can be selected to interconnect the horizontal conductor 14 and the vertical conductors 12. Such an embodiment is illustrated in FIG. 5 including matching meanderline couplers 20, 20A and 20B. A controller (not shown in FIG. 5) is connected to the meanderline couplers 20, 20A and 20B for selecting the operative coupler. A well-known switching arrangement can activate the selected meanderline coupler to connect the horizontal conductor 14 and the vertical conductors 12, dependent upon the desired antenna characteristics.

Figure 6:
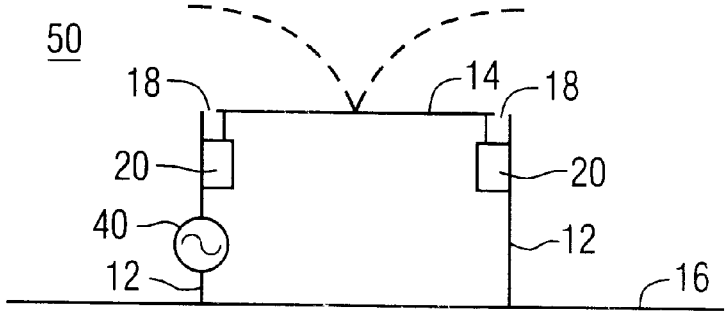
FIGS. 6 through 9 illustrate exemplary operational modes for a meanderline loaded antenna.
Figure 7:
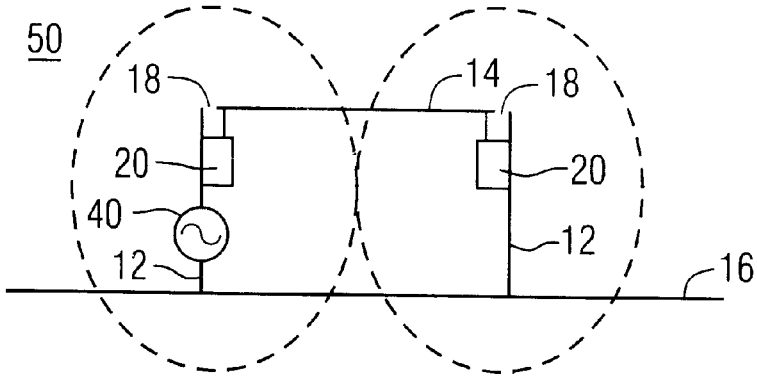

Turning to FIGS. 6 and 7, there is shown the current distribution (FIG. 6) and the antenna electric field radiation pattern (FIG. 7) for the meanderline loaded antenna 50 operating in a monopole or half wavelength mode as driven by a source 40. That is, in this mode, at a frequency of between approximately 800 and 900 MHz, the length of the meanderline couplers 20, the horizontal conductor 14 and the vertical conductors 12 is chosen such that the horizontal conductor 14 has a current null near the center and current maxima at each edge. As a result, a substantial amount of radiation is emitted from the vertical conductors 12, and little radiation is emitted from the horizontal conductor 14. The resulting field pattern has the familiar omnidirectional donut shape as shown in FIG. 7.

Those skilled in the art will realize that a frequency of between 800 and 900 MHz is merely exemplary. The antenna characteristics will change when excited by other frequency signals and the dimensions and material of the various antenna components (the meanderline couplers 20, the horizontal conductor 14 and the vertical conductors 12) can be modified to create an antenna having monopole-like characteristics at other frequencies. A meanderline loaded antenna such as that shown in FIGS. 3A and 3B will exhibit monopole-like characteristics at a first frequency and loop-like characteristics at second frequency, where there is a loose relationship between the two frequencies. Similar characteristics (i.e., monopole and loop characteristics) can be achieved at any other two loosely related frequencies by changing the antenna design.

Figure 8:
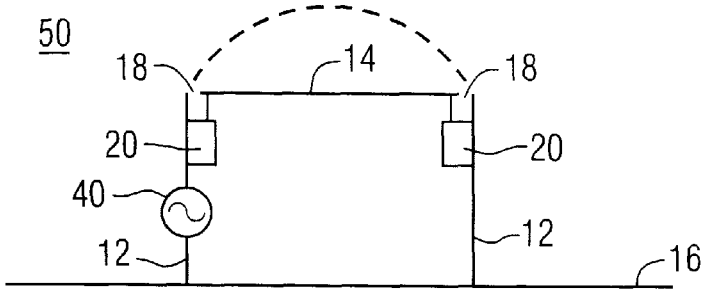
Figure 9:
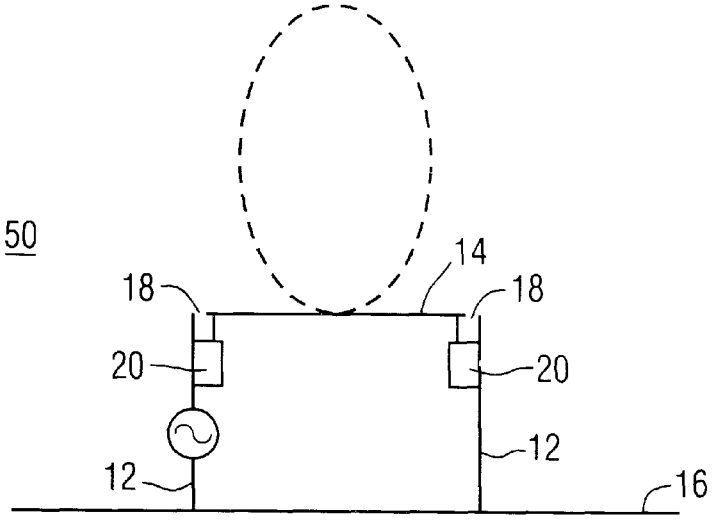

A second exemplary operational mode for the meanderline loaded antenna 50 is illustrated in FIGS. 8 and 9. This mode is the so-called loop mode. Note in this mode the current maxima occurs approximately at the center of the horizontal conductor 14 (see FIG. 8) resulting in an electric field radiation pattern as illustrated in FIG. 9. Note that the antenna characteristics displayed in FIGS. 8 and 9 are based on an antenna of the same electrical length (including the length of the meanderline couplers 20) as the antenna parameters depicted in FIGS. 6 and 7. Thus, at a frequency of approximately 800 to 900 MHz, the antenna displays the characteristics of FIGS. 6 and 7. For a signal frequency of approximately 1.5 GHz, the same antenna displays the characteristics of FIGS. 8 and 9. By changing the antenna design, monopole and loop characteristics can be attained at other loosely related frequency pairs.

Figure 10:
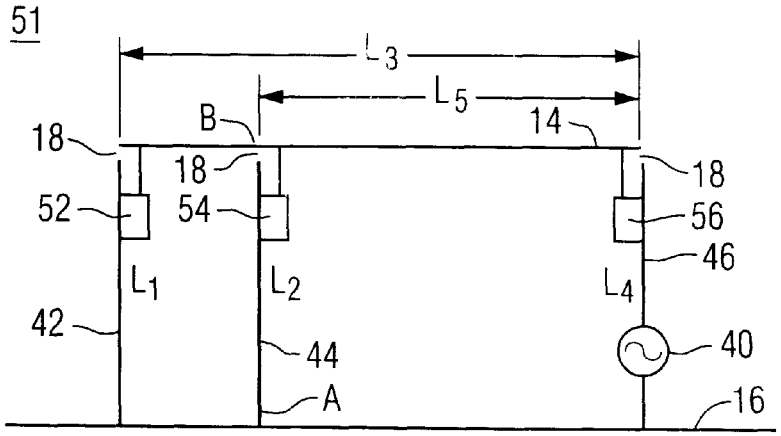
FIGS. 10–15 illustrate meanderline loaded antennae constructed according to the teachings of the present invention.

A meanderline loaded antenna 51 constructed according to the teachings of the present invention is illustrated in FIG. 10. As in the previous embodiments, the meanderline loaded antenna 51 includes a ground plane 16 and a horizontal conductor 14. According to the teachings of the present invention, the meanderline loaded antenna 51 further includes a plurality of vertical conductors 42, 44 and 46 each separated from the horizontal conductor 14 by a gap 18. The vertical conductor 42 includes a meanderline coupler 52; the vertical conductor 44 includes a meanderline coupler 54; the vertical conductor 46 includes a meanderline coupler 56. In the FIG. 10 embodiment, the meanderline loaded antenna 51 is driven by a signal source 40. According to the teachings of the present invention, the meanderline loaded antenna 52 includes a plurality of non-driven vertical conductors, such as the vertical conductors 42 and 44. The use of the two vertical conductors 42 and 44 on the non-driven side of the meanderline loaded antenna 51 provides two selectable antenna elements, each resonant at a different frequency. The length of a first vertical conductor (including the length of the accompanying meanderline coupler) is chosen to provide resonance at a first frequency and non-resonance at a second frequency. Conversely, the length of a second vertical conductor (including the meanderline coupler associated with it) is chosen to be non-resonant at the first frequency and resonant at the second desired frequency. By adjusting the second vertical conductor length to a quarter wavelength at the first frequency, so the second vertical conductor appears as an open circuit (i.e., is decoupled from the other antenna elements) at the first frequency and thus does not disturb or effect the operation of the meanderline antenna 51 at the first frequency.

The second vertical conductor length is chosen to provide resonance at a second operating frequency, where the first vertical coupler exhibits non-resonance. As shown below, the overall length of the meanderline antenna 51 can be adjusted so that the resonant and non-resonant conditions are achievable by adjusting the effective antenna length, including the lengths of the meanderline couplers 52, 54 and 56.

In case one, the meanderline loaded antenna 51 is configured to resonate at a frequency $f_1$. Therefore, the length of the various components of the meanderline loaded antenna 51 must be chosen as shown. With reference to FIG. 10, the antenna component lengths $L_1$, $L_2$, $L_3$, $L_4$, and $L_5$ represent, respectively, the electrical lengths of the vertical conductor 42 (including the meanderline coupler 52), the vertical conductor 44 (including the meanderline coupler 54), the horizontal conductor 14, the vertical conductor 46 (including the meanderline coupler 56), and the length of the horizontal conductor 14 between the vertical conductor 44 and the vertical conductor 46. For case one, the vertical conductor 42 (and the meanderline coupler 52), the horizontal conductor 14 and the vertical conductor 46 (and the meanderline coupler 56) are the active elements and have a total length of $L_1+L_3+L_4$. Together these elements form a resonant structure related to the frequency of the driving signal 40 as shown below, where the frequency of the driving signal is $f_1$. The length $L_2$ (the vertical conductor 44 plus the meanderline coupler 54) appears as an open circuit because it is a quarter wave multiple of the frequency $f_1$.

Case One: fi is the source frequency.

$$L_1 + L_3 + L_4 = \frac{n\lambda_1}{2}$$

This equation sets a resonant condition for $f_1$.

$$L_2 = \frac{m\lambda_1}{4}$$

This equation sets a condition such that the short circuit where the vertical conductor 44 meets the ground plane 16 (point A on FIG. 10) looks like an open circuit at the point where the horizontal conductor 14 meets the vertical conductor 44 (point B on FIG. 10).

where n is an integer and m is an odd integer.

Case two is similar to case one, except the vertical conductor 42 and its meanderline coupler 52 appear as on open circuit because they are a quarter wavelength multiple of the resonant frequency $f_2$.

Case Two: $f_2$ is the source frequency.

$$L_2 + L_4 + L_5 = \frac{n\lambda_2}{2}$$

$$L_1 = \frac{m\lambda_2}{4} \text{ or } L_1 + (L_3 - L_5) = \frac{m\lambda_2}{4}$$

where n is an integer and m is an odd integer

Note that, as compared with the prior art, no switching devices are necessary to selectably include or exclude either of the vertical conductors 42 or 44 from the meanderline loaded antenna 51. Instead, frequency selectivity is designed into the antenna by appropriate choice of the meanderline lengths, based on the operational frequency. The relationship between the various lengths of the antenna components and the meanderline couplers, in conjunction with the operating frequency, determine the operative antenna components. In particular, an antenna constructed according to the teachings of the present invention can be used for multiple applications employing different frequency bands. For instance, the antenna element links and the meanderline coupler links can be chosen such that the antenna can operate at PCS, cellular, Bluetooth (wireless) frequencies without the need for switching antenna elements in or out of the antenna structure.

Those skilled in the art will recognize that in other embodiments of the present invention more than two non-driven vertical conductors can be included in the meanderline loaded antenna 51. Each such vertical conductor will have an effective electrical length established by the physical length of the vertical conductor plus the length of the associated meanderline coupler, plus the length of the horizontal conductor 14 between the driven element and the non-driven element. Further, each vertical conductor will be placed a predetermined distance from the vertical conductor 46, thereby varying the effective length of the horizontal conductor 14. In this way, the meanderline loaded antenna 51 can be operative at a plurality of resonant frequencies as determined by the vertical conductor lengths including the associated meanderline coupler and the distance of the non-driven vertical conductor from the driven conductor. See for example, FIG. 11, where the non-driven vertical conductors are indicated by reference characters 42A–D and their associated meanderline couplers are indicated by reference characters 52A–D. FIG. 12 illustrates yet another embodiment including a plurality of driven vertical conductors: 46A driven at a frequency $f_1$, and having an associated meanderline coupler 56A, 46B driven at frequency f2 and having an associated meanderline coupler 56B, and 46C driven at a frequency of $f_3$ and having an associated meanderline coupler 56C. The FIG. 12 embodiment includes a non-driven vertical conductor 42 and its associated meanderline coupler 52. In accordance with the teachings of the present invention, the various vertical conductors 46A, 46B, 46C and 42 have a length, including their respective meanderline couplers and distance from the driven element, controlled to achieve an effective electrical length such that each of the conductors are resonant or non-resonant as desired. In particular, when the FIG. 12 antenna operates at frequency $f_1$, the vertical conductors 46B and 46C (including their associated meanderline couplers 56B and 56C) are controlled so that their effective electrical lengths present an open circuit at frequency $f_1$. During operation at frequencies f2 and f3 the remaining inoperative vertical conductors (and their associated meanderline couplers) present an open circuit at the operating frequency.

Figure 11:
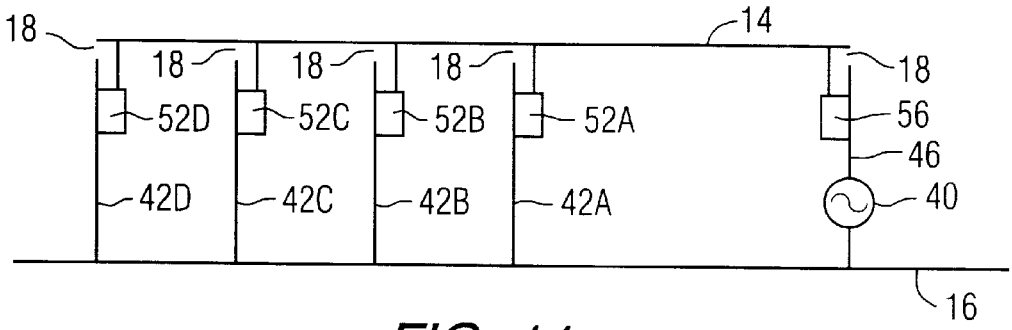
Figure 12:
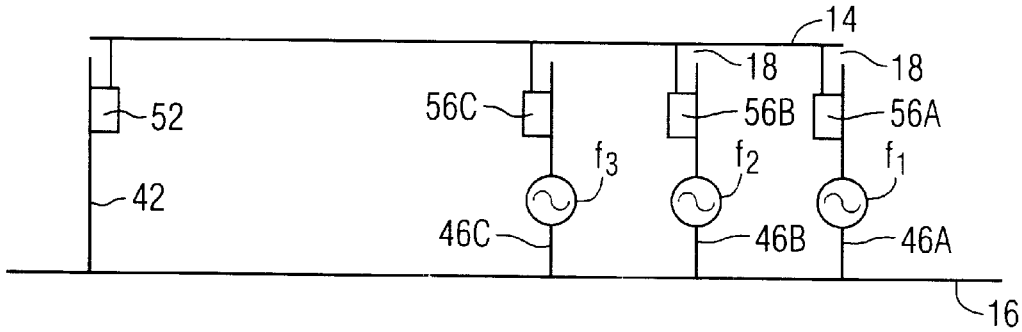
Figure 13:
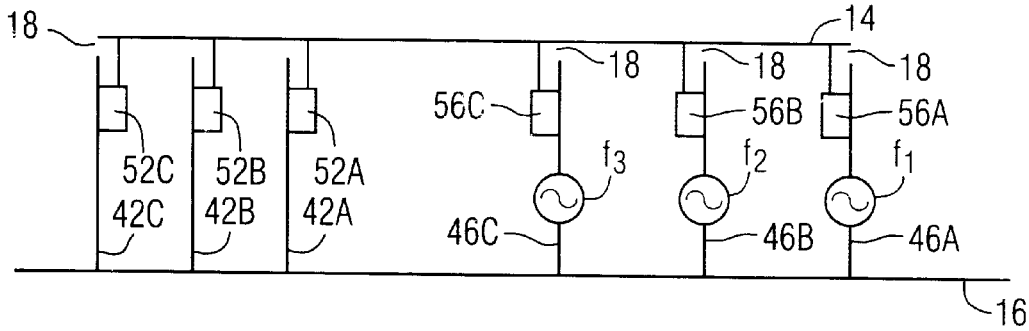

The representative embodiments shown in FIGS. 11 and 12 are combined in FIG. 13 wherein a plurality of driven and non-driven elements are illustrated. By appropriate selection of the meanderline lengths, vertical conductor lengths and the distance between the driven and non-driven elements, the various antenna elements present resonant or non-resonant conditions for the meanderline antenna. Further, switches or pin diodes can be used to control the meanderline lengths. If more than one of the sources is driven in FIG. 13 (or in FIG. 12) the FIG. 13 antenna provides a built-in summing function as determined by the effective length of the vertical conductors (including their associated meanderline couplers) and the amplitude and frequency (or phase) differential between multiple driving frequencies. This feature adds yet another degree of flexibility and design optimization according to the teachings of the present invention.

Figure 14:
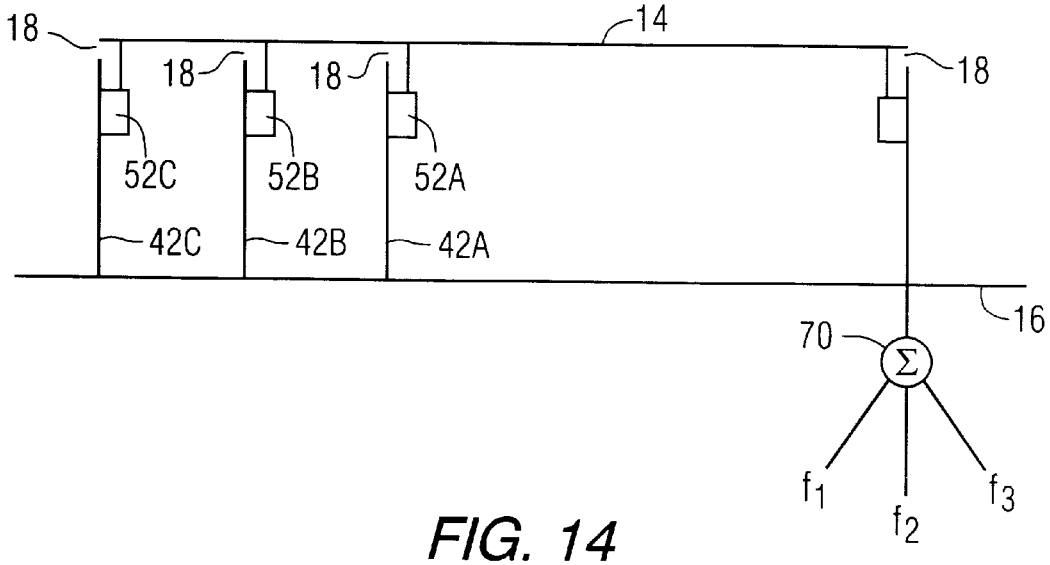
Figure 15:
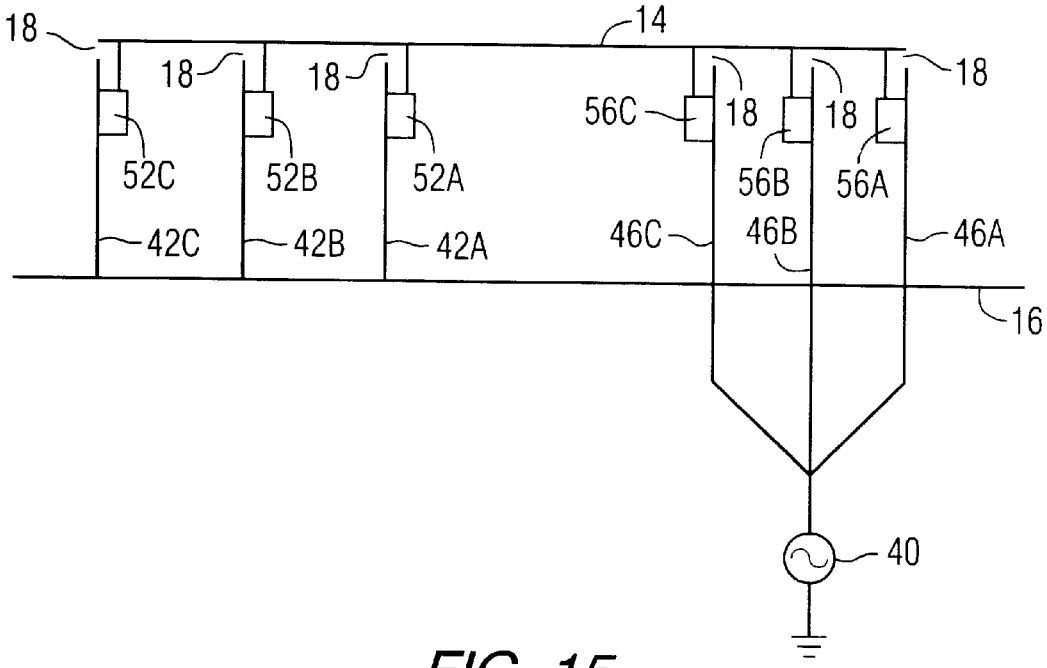

The FIG. 14 embodiment performs the frequency summing function externally with a summer 70. The input frequencies can be summed or only a single frequency can be provided (to achieve the desired antenna frequency characteristics). As with the other embodiments, the vertical conductors and the meanderline couplers are designed and/or can be controlled to change the effective lengths of the various antenna segments. FIG. 15 is yet another embodiment where the single source 40 feeds the vertical conductors 46A, 46B and 46C. In this embodiment, changing the frequency of the source 40 and designing and controlling each of the vertical conductors to be resonant or non-resonant as desired, allows a different vertical conductor to respond to different source frequencies. By using multiple vertical conductors each with an individual resonant frequency, the use of switches or pin diodes to control the meanderline lengths is avoided; instead, the appropriate resonant and non-resonant characteristics are designed into the antenna. Although FIGS. 10–15 show conductive elements grouped on one side of the antenna and the non-conductive elements grouped together on the other, those skilled in the art will realize that this is not a requirement of the present invention. The driven and non-driven elements can be spaced anywhere along the horizontal conductor 14 and the ground plane 16, as long as the resonant and non-resonant conditions taught by the present invention are satisfied.

Adding yet another dimension to the meanderline loaded antenna 51, as discussed above in conjunction with FIG. 1, each meanderline coupler can include one or more controllable switches or pin diodes to change the electrical length of the meanderline coupler. In this way, the resonant frequency of the meanderline loaded antenna 51 can be further adjusted even after the physical lengths $L_1$, $L_2$, $L_3$, $L_4$ and $L_5$ shown in FIG. 10 have been established.

As discussed above, in conjunction with FIGS. 6–9, the meanderline loaded antenna 50 can operate in two different modes in dependence upon the operating frequency and the electrical lengths of the entire antenna. This same multi-mode characteristics are achievable with the meanderline loaded antenna 51 of FIG. 10, once the electrical lengths have been established as discussed above. Generally speaking, the prior art antennae intended for dual or multi-band operation use a single antenna that is optimized for a selected mode or frequency. When operation is desired at a different frequency, the same antenna is utilized but, as expected, performance is degraded. According to the teachings of the present invention, two or more operational frequency bands are available by judicious choice of the lengths shown in FIG. 10 and the additional exemplary embodiments of FIGS. 11–15, as illustrated by cases one and two set forth above. As a result, multi-band operation without degraded performed is available from a single antenna constructed according to the teachings of the present invention.

Figure 16:
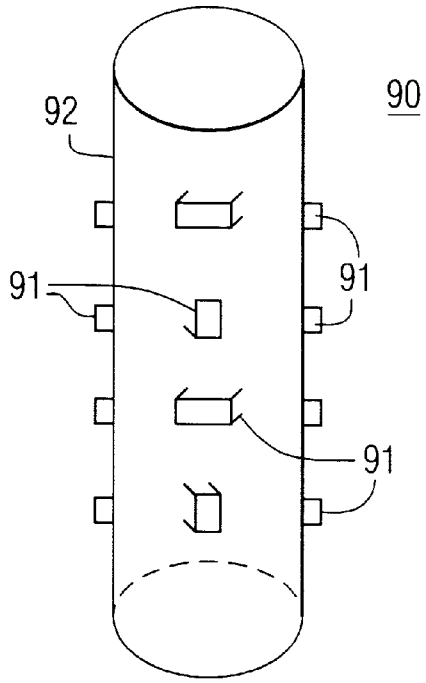
FIGS. 16 and 17 illustrate antennae arrays using meanderline loaded antennae of the present invention.

FIG. 16 depicts an exemplary embodiment wherein the meanderline loaded antennae 91 constructed according to the teachings of the present invention are used in an antenna array 90. The individual meanderline antennae 91 are fixedly attached to a cylinder 92 that serves as the ground plane 16 and provides a signal path to the individual meanderline antennae 91. Advantageously, the meanderline antennae 91 are disposed in alternating horizontal and vertical configurations to produce alternating horizontally and vertical polarized signals. That is, the first row of meanderline loaded antennae are disposed horizontally to produce a horizontally polarized signal in the transmit mode and those in the second row are disposed vertically to produce vertically polarized signals in the transmit mode. Operation in the receive mode is in accord with the antenna reciprocity theorem. Although only four rows of the meanderline loaded antennae 91 are illustrated in FIG. 16, those skilled in the art will recognize that additional parallel rows can be included in the antenna array 90 so as to provide additional gain. The gain of the antenna array 90 comprises both the element factor and the array factor, as is well known in the art.

Figure 17:
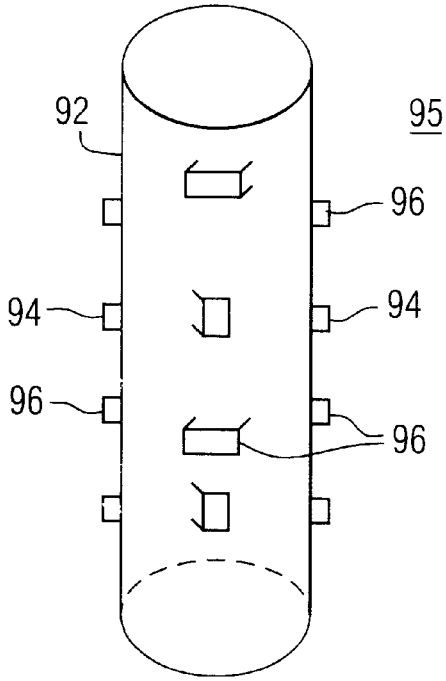

FIG. 17 illustrates yet another antenna array embodiment including horizontally oriented elements 96 and vertically oriented elements 94. As can be seen, the horizontally oriented elements 96 are staggered above and below the circumferential element centerline from one consecutive row of horizontal elements to the next. Although consecutive vertical elements are shown in a linear orientation, they too can be staggered. Staggering of the elements provides improved array performance.

While the invention has been described with reference to preferred embodiments, it will be understood by those skilled in the art that various changes may be made and equivalent elements may be substituted for elements thereof without departing from the scope of the present invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a conductive plate;

a driven upright conductive element connected to said conductive plate and projecting away from said conductive plate;

a plurality of non-driven upright conductive elements connected to said conductive plate in a substantially parallel spaced apart orientation with respect to each other and to said driven conductive element, wherein said plurality of non-driven upright conductive elements project away from said conductive plate;

a top conductive element bridging the space between said driven conductive element and said plurality of non-driven conductive elements, wherein said top conductive element is spaced away from said plurality of non-driven conductive elements so as to create a gap therebetween, wherein said top conductive element is spaced apart from said driven conductive element so as to create a gap therebetween, and wherein said top conductive element is spaced apart from said conductive plate;

a first plurality of meanderline couplers equal in number to the plurality of non-driven conductive elements, wherein one of said first plurality of meanderline couplers is connected between each one of said plurality of non-driven conductive elements and said top conductive element so as to provide an electrical path across the gap therebetween;

a second meanderline coupler connected between said driven conductive element and said top conductive element so as to provide an electrical path across the gap therebetween;

wherein said first plurality of meanderline couplers and said second meanderline coupler have an effective electrical length that affects the electrical length and operating characteristics of the antenna; and wherein at least one of said plurality of non-driven conductive elements has an effective length that is an odd multiple of a quarter wavelength at a selected operating frequency.

2. The antenna of claim 1 wherein the top conductive element is substantially equidistant at all points from the conductive plate.

3. The antenna of claim 1 wherein the conductive plate is substantially flat and the top conductive element is parallel thereto.

4. The antenna of claim 1 wherein the distance between the conductive plate and the top conductive element is chosen to achieve certain antenna characteristics.

5. The antenna of claim 1 wherein the effective electrical length of the plurality of non-driven conductive elements and the driven conductive element includes the length thereof plus the length of the meanderline coupler connected thereto.

6. The antenna of claim 1 wherein all except one of said plurality of non-driven conductive elements have an effective length that is an odd multiple of a quarter wavelength at a selected antenna operating frequency.

7. The antenna of claim 1 wherein all except one of said plurality of non-driven conductive elements present an open circuit at a selected antenna operating frequency.

8. The antenna of claim 1 wherein one of the plurality of non-driven conductive elements is operative, and wherein the remaining ones of the plurality of non-driven conductive elements have an effective electrical length that is an odd multiple of a quarter wavelength at a selected frequency.

9. The antenna of claim 8 wherein the sum of the effective electrical length of the operative conductive element, plus the effective electrical length of the driven conductive element, plus the effective electrical length of the top plate between the operative non-driven conductive element and the driven conductive element is a multiple of a half wavelength at a selected frequency.

10. The antenna of claim 1 wherein one of the plurality of non-driven conductive elements is operative, and wherein the remaining ones of the plurality of non-driven conductive elements present an open circuit at a selected frequency.

11. The antenna of claim 1 further comprising:

a third plurality of meanderline couplers equal in number to the plurality of non-driven conductive elements, wherein one of said third plurality of meanderline couplers is serially connected between each one of said plurality of non-driven conductive elements, wherein each one of said third plurality of meanderline couplers is connected in parallel with one of the first plurality of meanderline couplers;

a fourth meanderline coupler serially connected between said driven conductive element and said top conductive element in parallel with the second meanderline coupler;

a controller for selecting either the first or the third plurality of meanderline couplers associated with the non-driven conductive elements, and for selecting either the second or the fourth meanderline coupler associated with the driven conductive element, wherein the selected meanderline couplers become active elements of the antenna.

12. The antenna of claim 1 wherein the driven conductive element and the plurality of non-driven conductive elements are orthogonally connected to the conductive plate.

13. The antenna of claim 1 wherein the first plurality of meanderline couplers and the second meanderline coupler have a controllable effective length.

14. The antenna of claim 1 wherein the plurality of non-driven conductive elements are substantially equally spaced apart at a first distance, and wherein the distance between the driven conductive element and the nearest one of the plurality of non-driven conductive elements is greater than the first distance.

15. The antenna of claim 1 wherein the distance between adjacent non-driven conductive elements from among the plurality of non-driven conductive elements are spaced apart a distance less than the distance between the driven conductive element and the nearest non-driven conductive element thereto.

16. The antenna of claim 1 including a plurality of driven conductive elements connected to said conductive plate and projecting away from said conductive plate.

17. The antenna of claim 1 wherein the driven conductive element is located between two of the plurality of non-driven conductive elements.

18. The antenna of claim 1 wherein the driven conductive element is driven from a multiple frequency source, wherein said multiple frequency source comprises a summer responsive to a plurality of differing frequency signals.

19. The antenna of claim 1 including a plurality of driven conductive elements each having a different effective length and wherein the plurality of driven conductive elements are driven from a single frequency source.

20. An antenna array comprising:

a ground plane;

a plurality of antenna elements connected to said ground plane, wherein each antenna element comprises:

a driven upright conductive element connected to said conductive plate and projecting away from said conductive plate;

a plurality of non-driven upright conductive elements connected to said conductive plate in a substantially parallel spaced apart orientation with respect to each other and to said driven conductive element, and projecting away from said conductive plate;

a top conductive element bridging the space between said driven conductive element and said plurality of non-driven conductive elements, wherein said top conductive element is spaced away from said plurality of non-driven conductive elements so as to create a gap therebetween, wherein said top conductive element is spaced apart from said driven conductive element so as to create a gap therebetween, and wherein said top conductive element is spaced apart from said conductive plate;

a first plurality of meanderline couplers equal in number to the plurality of non-driven conductive elements, wherein one of said first plurality of meanderline couplers is connected between each one of said plurality of non-driven conductive elements and said top conductive element so as to provide an electrical path across the gap therebetween;

a second meanderline coupler connected between said driven conductive element and said top conductive element so as to provide an electrical path across the gap therebetween;

wherein said first plurality of meanderline couplers and said second meanderline coupler have an effective electrical length that affects operating characteristics of the antenna; and wherein at least one of said plurality of non-driven conductive elements has an effective length that presents an open circuit at a selected antenna operating frequency.

21. The antenna array of claim 20 wherein a first number of the plurality of antenna elements are oriented for vertical polarization, and wherein a second number of the plurality of antenna elements are oriented for horizontal polarization.

22. The antenna array of claim 21 wherein the ground plane is cylindrically shaped, and wherein the first number of the plurality of the antenna elements are spaced circumferentially around the ground plane at a first axial location, and wherein the second number of the plurality of antenna elements are spaced circumferentially around the ground place at a second axial location, spaced apart from said first axial location.

23. The antenna array of claim 22 wherein the second number of the plurality of antenna elements includes four antenna elements spaced circumferentially at 90 degrees apart.

24. The antenna array of claim 22 wherein the first number of the plurality of antenna element includes four antenna elements spaced circumferentially at 90 degrees apart.

25. The antenna array of claim 21 wherein the ground plane is cylindrically shaped and wherein the second number of the plurality of the antenna element are spaced circumferentially around the ground plane such that all of the second number are slightly staggered about a first axial location, and wherein the first number of the plurality of the antenna elements are spaced circumferentially around the ground plane at a second axial location, spaced apart from said first axial location.

* * * * *